US012760676B2

(12) United States Patent
Meyer et al.

(10) Patent No.: US 12,760,676 B2
(45) Date of Patent: Oct. 13, 2026

(54) AFTERTREATMENT SYSTEM HEATER CONTROLS

(71) Applicant: Cummins Inc., Columbus, IN (US)

(72) Inventors: William D. Meyer, Columbus, IN (US); Sarang Gupta, Nagpur (IN); Surabhi Kushwaha, Nagpur (IN); Janhavi Subhash Kalyanshetty, Pune (IN)

(73) Assignee: Cummins Inc., Columbus, IN (US)

( * ) Notice: Subject to any disclaimer, the term of this patent is extended or adjusted under 35 U.S.C. 154(b) by 133 days.

(21) Appl. No.: 18/974,887

(22) Filed: Dec. 10, 2024

(65) Prior Publication Data

US 2025/0215817 A1 Jul. 3, 2025

Related U.S. Application Data

(60) Provisional application No. 63/615,395, filed on Dec. 28, 2023.

(51) Int. Cl.
*F01N 9/00* (2006.01)
*F01N 3/20* (2006.01)

(52) U.S. Cl.
CPC ..... *F01N 9/00* (2013.01); *F01N 3/2013* (2013.01); *F01N 3/2026* (2013.01); *F01N 2550/22* (2013.01); *F01N 2900/04* (2013.01); *F01N 2900/0418* (2013.01); *F01N 2900/0602* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,503,804 | A | 4/1996 | Fujishita et al. | |
| 6,050,086 | A | 4/2000 | Ishizuka et al. | |
| 8,925,301 | B2 | 1/2015 | Hashimoto | |
| 9,388,722 | B2 | 7/2016 | Gonze et al. | |
| 2015/0218995 | A1* | 8/2015 | Hashimoto | F01N 3/20 60/286 |
| 2022/0025808 | A1* | 1/2022 | Ellmer | F01N 13/0097 |
| 2022/0082041 | A1* | 3/2022 | Kotlar | F01N 3/2013 |
| 2022/0243631 | A1* | 8/2022 | Swart | F01N 3/2013 |
| 2022/0333516 | A1* | 10/2022 | Hirooka | F01N 3/2013 |
| 2022/0364488 | A1* | 11/2022 | Stoltz | B60L 1/02 |
| 2023/0094717 | A1* | 3/2023 | Hirooka | F01N 3/108 60/320 |
| 2024/0035408 | A1* | 2/2024 | Zein | B01D 46/4263 |

* cited by examiner

*Primary Examiner* — Binh Q Tran
(74) *Attorney, Agent, or Firm* — Taft Stettinius and Hollister LLP

(57) ABSTRACT

An exhaust aftertreatment system and a method thereof is provided. The system includes a heater configured to provide heat to a catalyst. The system further includes a heater control unit (HCU) configured to supply electrical power to the heater, and a power supply control unit (PSCU) configured to supply electrical power to the HCU at a variable voltage. The HCU is configured to determine a setpoint parameter which varies in response to variation in a commanded power output of the HCU to drive the heater. The PSCU is configured to receive the setpoint parameter and to adjust the variable voltage supplied to the HCU in response to the setpoint parameter. The adjustment of the setpoint parameter is effective to optimize an efficiency of the HCU during operation to supply the commanded power output to the heater.

20 Claims, 3 Drawing Sheets

AFTERTREATMENT SYSTEM HEATER CONTROLS

The present application claims priority to and the benefit of U.S. Application No. 63/615,395 filed Dec. 28, 2023 and the same is hereby incorporated by reference.

BACKGROUND

Background

The present application relates to aftertreatment system heater controls and related apparatuses, processes, systems and techniques. Exhaust aftertreatment systems may utilizes heaters to head catalysts or other aftertreatment system components to provide necessary or desirable operating temperatures. A number of proposals have been made for controlling heaters catalysts of aftertreatment systems for internal combustion systems. Existing approaches to aftertreatment catalyst heating suffer from a number of disadvantages, drawbacks, problems, and shortcomings. There remains a significant need for the unique apparatuses, processes, and systems disclosed herein.

DISCLOSURE OF EXAMPLE EMBODIMENTS

For the purposes of clearly, concisely, and exactly describing example embodiments of the present disclosure, the manner, and process of making and using the same, and to enable the practice, making and use of the same, reference will now be made to certain example embodiments, including those illustrated in the figures, and specific language will be used to describe the same. It shall nevertheless be understood that no limitation of the scope of the invention is thereby created, and that the invention as set forth in the claims following this disclosure includes and protects such alterations, modifications, and further applications of the example embodiments as would occur to one skilled in the art with the benefit of the present disclosure.

SUMMARY OF THE DISCLOSURE

Some embodiments include unique aftertreatment system heater control apparatus. Some embodiments include unique aftertreatment system heater control systems. Some embodiments include unique aftertreatment system heater control processes. Further embodiments, forms, objects, features, advantages, aspects, and benefits shall become apparent from the following description and drawings.

DETAILED DESCRIPTION OF EXAMPLE EMBODIMENTS

Figure 1:
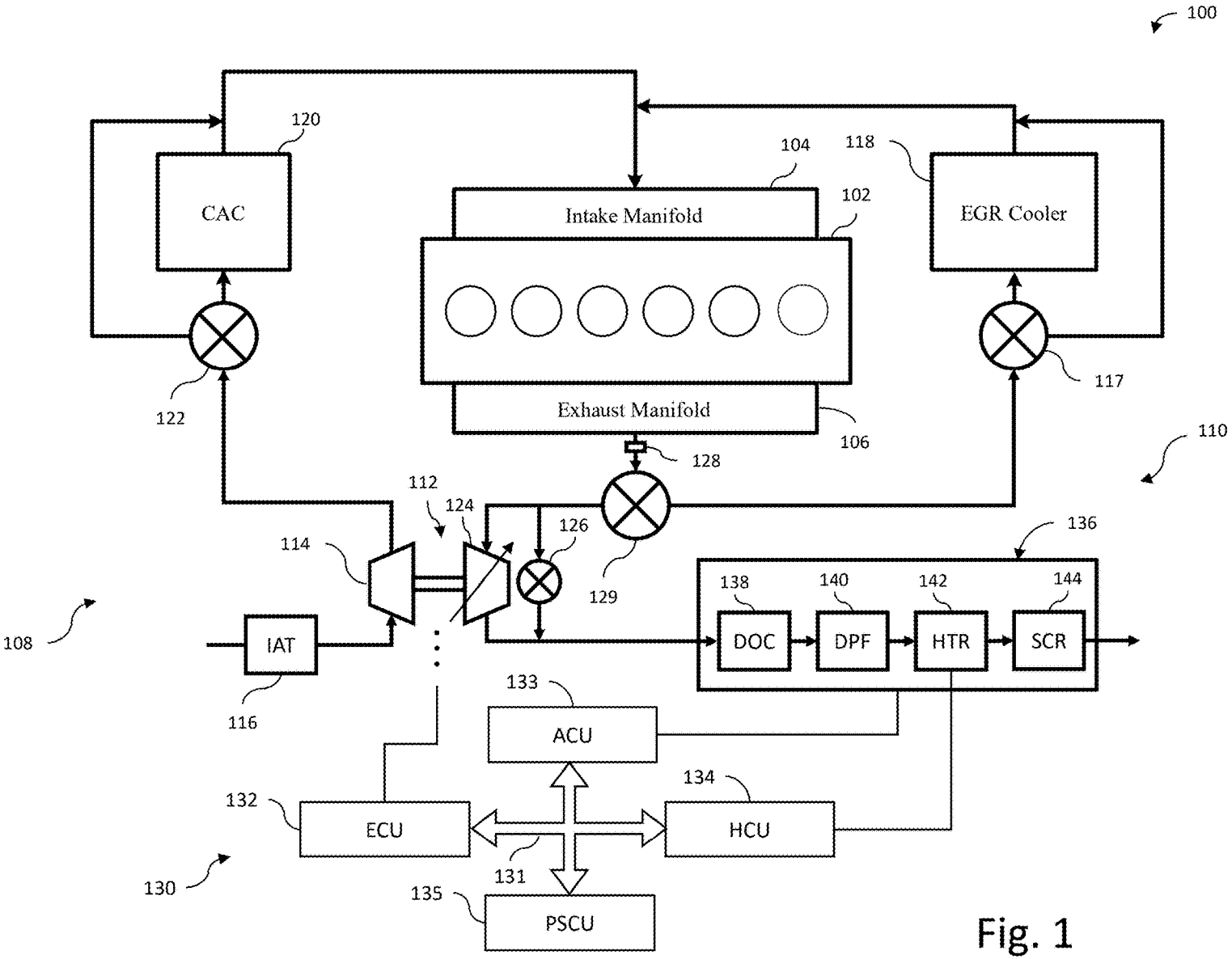
FIG. 1 is a schematic diagram illustrating certain aspects of an example prime mover system.

With reference to FIG. 1, there is illustrated an example prime mover system 100 (also referred to herein as system 100) including a prime mover in the form of an internal combustion engine (ICE) 102. System 100 may be provide in a number of forms including, for example, in the form of a vehicle or vehicle powertrain system (e.g., an on-highway vehicle or vehicle powertrain system or an off-highway vehicle or vehicle powertrain system), a work machine or work machine powertrain system, a genset or genset powertrain system, or a hydraulic fracturing rig or hydraulic fracturing rig powertrain system, to name several non-limiting examples. In shall be appreciated that system 100 may include a number of other components as will occur to one of skill in the art with the benefit and insight of the present disclosure. Furthermore, while engine 102 is provided as a prime mover of system 100 in the illustrated embodiment, other embodiments may comprise other types of prime movers, for example, battery electric drive systems, hybrid ICE-battery electric systems, a fuel cell electric drive system, or prime mover systems comprising combinations of the foregoing and/or other types of prime mover system as will occur to one of skill in the art with the benefit and insight of the present disclosure.

System 100 includes an intake system 108 and an exhaust system 110. The engine 102 is in fluid communication with the intake system 108 through which charge air enters an intake manifold 104 and is also in fluid communication with the exhaust system 110, through which exhaust gas resulting from combustion exits by way of an exhaust manifold 106. The engine 102 includes a number of cylinders (e.g., cylinders 1 through 6) forming combustion chambers in which a charge flow mixture of fuel and air is combusted. For example, the energy released by combustion powers the engine 102 via pistons in the cylinders connected to a crankshaft. Intake valves control the admission of charge air into the cylinders, and exhaust valves control the outflow of exhaust gas through exhaust manifold 106 and ultimately to the atmosphere. It shall be appreciated that the exhaust manifold 106 may be a single manifold or multiple exhaust manifolds.

The turbocharger 112 includes a compressor 114 configured to receive filtered intake air via an intake air throttle (IAT) 116 of the intake system 108 and operable to compress ambient air before the ambient air enters the intake manifold 104 of the engine 102 at increased pressure. The air from the compressor 114 is pumped through the intake system 108, to the intake manifold 104, and into the cylinders of the engine 102, typically producing torque on the crankshaft. IAT 116 is flow coupled with a charge air cooler (CAC) 120 which is operable to cool the charge flow provided to the intake manifold 104. The intake system 108 also includes a CAC bypass valve 122 which can be opened to route a portion or all of the charge flow to bypass the CAC 120. Adjusting the bypass position of the CAC bypass valve 122 increasingly raises the temperature of the gas returned to the intake manifold 104.

It is contemplated that in system 100, the turbocharger 112 may be a variable geometry turbocharger (VGT) or a fixed geometry turbocharger. A variable geometry turbine allows significant flexibility over the pressure ratio across the turbine. In diesel engines, for example, this flexibility can be used for improving low speed torque characteristics, reducing turbocharger lag and driving exhaust gas recirculation flow. In an example embodiment, the VGT 124 can be adjusted to increase engine load and thereby configured to increase exhaust gas temperature. System 100 also includes a turbine bypass valve 126 to bypass the turbocharger 112. Since cooler ambient air is introduced at the turbocharger 112, opening the turbine bypass valve 126 allows for the turbocharger 112 to be bypassed and maintain a higher intake air temperature at the intake manifold 104.

The exhaust system 110 includes an exhaust gas temperature sensor 128 to sense the temperature of the gas exiting the exhaust manifold 106. The exhaust system 110 includes an exhaust gas recirculation (EGR) valve 129 which recirculates a portion of exhaust gas from the exhaust manifold 106 back to the intake manifold 104. The exhaust system 110 includes an EGR cooler (EGR-C) 118 which cools the gas exiting the exhaust manifold 106 before the gas returns to the intake manifold 104. The exhaust system 110 may also include an EGR-C bypass valve 117 which can be opened to route a portion or all of the recirculated exhaust gas from the exhaust manifold 106 to bypass the EGR-C 118. By increasing the amount of gas that bypasses the EGR-C 118, the temperature of the gas returning to the intake manifold 104 is increased. It shall be appreciated that the intake system 108 and/or the exhaust system 110 may further include various components not shown, such as additional coolers, valves, bypasses, intake throttle valves, exhaust throttle valves, and/or compressor bypass valves, for example.

System 100 includes an exhaust aftertreatment (AT) system 136 which includes a diesel oxidation catalyst (DOC) 138, a diesel particulate filter (DPF) 140, aftertreatment (AT) heater 142, and a selective catalytic reduction (SCR) 144. In the example embodiment, the AT heater 142 is optionally included in the AT system 136 to increase the temperature of the exhaust gas provided to the SCR 144 within the AT system 136. It should be noted that AT heater 142 can include one or more electric heaters distributed at various locations at, on, within, or upstream of SCR 144 or other catalyst elements of AT system 136.

System 100 includes an electronic control system (ECS) 130. In the illustrated embodiment, ECS 130 include an engine control unit (ECU) 132, an aftertreatment control unit (ACU) 133, a heater control unit (HCU) 134, and power system control unit (PSCU) 135 which are operatively communicatively coupled with one another via one or more datalinks 131 which may comprise one or more controller area networks (CAN) and/or other types of datalinks. System 100 may include a number of other control units and controller as will occur to one of skill in the art with the benefit and insight of the present disclosure.

ECU 132 is operatively communicatively coupled with and configured and operable to control operation of and/or receive inputs from actuators, controllers, devices, sensors, and/or other components of system 100 including, for example, a number of the aforementioned features of system 100.

HCU 134 is operatively coupled with and configured and operable to control operation of and/or receive inputs from AT heater 142. It shall be appreciated that various communications hardware and protocols may be utilized to implement, such as one or more controller area networks (CAN) or other communications components.

PSCU 135 operatively communicatively coupled with and configured and operable to control operation of and/or receive inputs from an electrical power system of system 100 such as, for example, a motor generator system, a battery system, or other types of electrical power systems.

ECU 132, ACU 133, HCU 134, PSCU 135, and other components of ECS 130 may include one or more programmable controllers of a solid-state, integrated circuit type, and one or more non-transitory memory media configured to store instructions executable by the one or more microcontrollers. For purposes of the present application the term controller shall be understood to also encompass microcontrollers, microprocessors, application specific integrated circuits (ASIC), other types of integrated circuit processors and combinations thereof.

ECU 132, ACU 133, HCU 134, PSCU 135, and other components of ECS 130 may be implemented in any of a number of ways that combine or distribute the control function across one or more control units in various manners. The ECS 130 may execute operating logic that defines various control, management, and/or regulation functions. This operating logic may be in the form of dedicated hardware, such as a hardwired state machine, analog calculating machine, programming instructions, and/or a different form as would occur to those skilled in the art. The ECS 130 may be provided as a single component or a collection of operatively coupled components; and may be comprised of digital circuitry, analog circuitry, or a hybrid combination of both of these types. When of a multi-component form, the ECS 130 may have one or more components remotely located relative to the others in a distributed arrangement. The ECS 130 can include multiple processing units arranged to operate independently, in a pipeline processing arrangement, in a parallel processing arrangement, or the like. It shall be further appreciated that the ECS 130 and/or any of its constituent components may include one or more signal conditioners, modulators, demodulators, Arithmetic Logic Units (ALUs), Central Processing Units (CPUs), limiters, oscillators, control clocks, amplifiers, signal conditioners, filters, format converters, communication ports, clamps, delay devices, memory devices, Analog to Digital (A/D) converters, Digital to Analog (D/A) converters, and/or different circuitry or components as would occur to those skilled in the art to perform the desired communications.

ECU 132, ACU 133, HCU 134, PSCU 135, and other components of ECS 130 may include one or more non-transitory memory devices configured to store instructions in memory which are readable and executable by a controller to control operation of engine 102 as described herein. Certain control operations described herein include operations to determine one or more parameters. ECU 132, ACU 133, HCU 134, PSCU 135, and other components of ECS 130 may be configured to determine and may perform acts of determining in a number of manners, for example, by calculating or computing a value, obtaining a value from a lookup table or using a lookup operation, receiving values from a datalink or network communication, receiving an electronic signal (e.g., a voltage, frequency, current, or pulse-width modulation (PWM) signal) indicative of the value, receiving a parameter indicative of the value, reading the value from a memory location on a computer-readable medium, receiving the value as a run-time parameter, and/or by receiving a value by which the interpreted parameter can be calculated, and/or by referencing a default value that is interpreted to be the parameter value.

Figure 2:
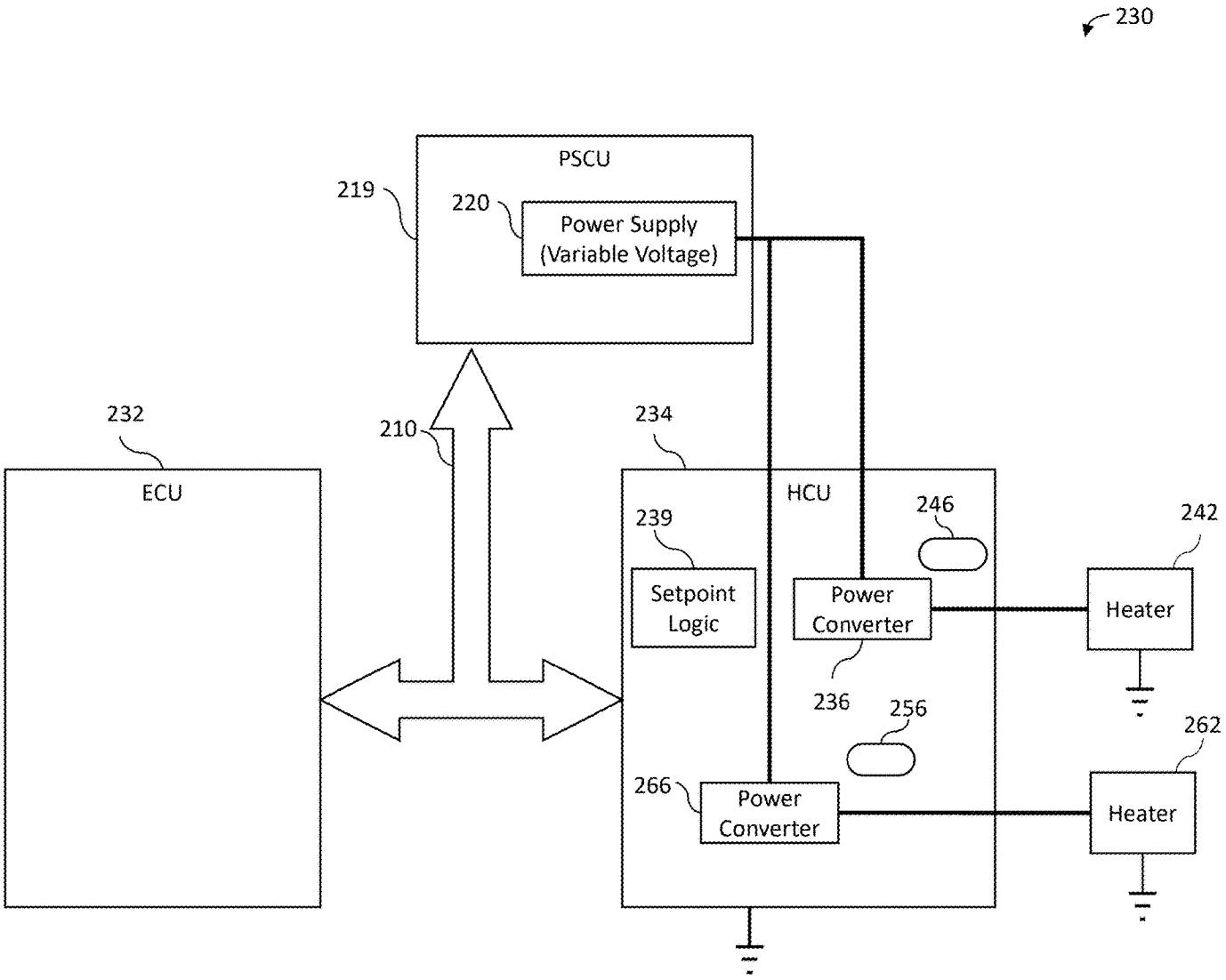
FIG. 2 is a schematic diagram illustrating certain aspects of an example electronic control system implementation.

With reference to FIG. 2 there are illustrated certain aspects of an example electronic control system (ECS) 230. In the illustrated example, ECS 230 includes a first electronic control unit which is configured and provided in the form of heater control unit (HCU) 234. In the illustrated example, ECS 230 also includes, a second electronic control unit which is configured and provided in the form of engine control module (ECU) 232. ECS 230 further includes a third electronic control unit which is configured and provided in the form of power system control unit (PSCU) 219.

In the illustrated example, HCU 234 is configured and provided with two output channels. A first output channel of HCU 234 is configured to drive heater 242 using power from power supply (PS) 220 and power converter 236 which is operatively coupled with and configured to receive power from power supply 220 to selectably power a load of heater 242. A second output channel of HCU 234 is configured to drive heater 262 using power from power supply 220 and power converter 266 which is operatively coupled with and configured to receive power from power supply 220 to selectably power a load of heater 262.

PSCU 219 is configured and operable to control operation of power supply 220. power supply 220 may be configured and provided in a number of forms including, for example, electrical power systems including a battery-based power source, an alternator-based or generator-based power source, a battery and alternator or generator-based power source, or other types of electrical power source as will occur to one of skill in the art with the benefit and insight of the present disclosure. In some embodiments, electrical power source may be configured and provided as a 48V DC electrical power source.

ECU 232 is configured to send communication to HCU 234 and receive communication from HCU 234 via one or more datalinks 210 which may be configured and provided, for example, as one or more controller area networks (CAN) or one or more other types of data links. In some embodiments, ECU 232, HCU 234, and PSCU 219 may be in operative communication with a common datalink of the one or more datalinks 210 (for example, a common CAN) and may be configured and operable to communicate with one another via the common datalink. In some embodiments, the one or more datalinks 210 may comprise a first datalink (for example, a first CAN), and a second datalink (for example a second CAN). In some such embodiments, ECU 232 and HCU 234 may be in operative communication with the first datalink and configured and operable to communicate with one another via the first datalink. In some such embodiments, ECU 232 and PSCU 219 may be in operative communication with the second datalink and configured and operable to communicate with one another via second first datalink.

One or more sensors 246 are configured to sense one or more operational characteristics of or associated with a load of heater 242. In the illustrated example, the one or more sensors 246 comprise one or more voltage sensors configured to sense a voltage of or associated with the load of heater 242, and one or more current sensors configured to sense a current of or associated with the load of heater 242. In some embodiments, the one or more sensors 246 may comprise additional sensors such as one or more temperature sensors configured to sense a temperature of or associated with the load of heater 242.

One or more sensors 256 are configured to sense one or more operational characteristics of or associated with a load of heater 262. In the illustrated example, the one or more sensors 256 comprise one or more voltage sensors configured to sense a voltage of or associated with the load of heater 262, and one or more current sensors configured to sense a current of or associated with the load of heater 262. In some embodiments, the one or more sensors 256 may comprise additional sensors such as one or more temperature sensors configured to sense a temperature of or associated with the load of heater 262.

Output of the one or more sensors 246 associated with the load of heater 242 and output of the one or more sensors 256 associated with the load of heater 262 may be provided as or utilized in determining setpoint determination logic 239.

HCU 234 includes setpoint determination logic 239 which may be implemented in connection with a microcontroller, memory, and/or other control structures of HCU 234. In one aspect, setpoint determination logic 239 is configured to determine a heater load resistance. In some embodiments, setpoint determination logic 239 is configured to determine a heater load resistance in response to a measured output voltage of the HCU 234 and a measured output current of the HCU 234, for example, by dividing measured output voltage by measured output current.

In another aspect, setpoint determination logic 239 is configured to determine a target HCU output current. In some embodiments, setpoint determination logic 239 is configured to determine a target HCU output current in response to a commanded power output of the HCU 234 and the heater load resistance. In some forms, setpoint determination logic 239 may be configured to determine a target HCU output current by calculating the square root of the ratio of the commanded power output and the heater load resistance (Iout_target=SQRT(P_command/R_load). In some forms, setpoint determination logic 239 may be configured to determine a target HCU output current using a lookup table (LUT) configured with empirically determined target HCU output current for corresponding commanded power output values and heater load resistance values.

In another aspect, setpoint determination logic 239 is configured to determine a target HCU output voltage. In some embodiments, setpoint determination logic 239 may be configured to determine a target HCU output voltage in response to the commanded power output and the target HCU output current, for example, by taking a ratio of or dividing commanded power output of the HCU by target HCU output current (Vout_target=P_command/Iout_target).

In another aspect, setpoint determination logic 239 is configured to determine a HCU voltage drop. In some embodiments, setpoint determination logic 239 may be configured to determine a HCU voltage drop in response to a measured input voltage of HCU 234 and a measured output voltage of HCU 234. In some embodiments, setpoint determination logic 239 may be configured to determine a HCU voltage drop in response to one or more predetermined value of HCU 234. In some embodiments, setpoint determination logic 239 may be configured to determine a HCU voltage drop in response to one or more predetermined value of HCU 234 which may be adjusted or scaled in response to one or more operating parameters of HCU 234, for example, a power converter duty cycle.

In another aspect, setpoint determination logic 239 is configured to determine a setpoint parameter, for example, a voltage setpoint for power provided by PSCU 219 to HCU 234 which may also be considered an input voltage setpoint (Vin_set). In some embodiments, setpoint determination logic 239 may be configured to determine the setpoint parameter in response to the target HCU output voltage, the HCU voltage drop, and an optimal power converter duty cycle, for example, by dividing the target HCU output voltage by the sum of the HCU voltage drop and the optimal power converter duty cycle (Vin_set=Vtarget/DC_optimal+Vhcu_vdrop). The optimal power converter duty cycle may comprise, for example, an optimal DC-DC converter duty cycle which may be a predetermined value or may be an adjusted or scaled value determined in response to one or more operating parameters of HCU 234).

In some embodiments, the setpoint parameter determined by setpoint determination logic 239 may be communicated and provided by the HCU 234 to the ECU 232 and, in turn, may be communicated and provided by the ECU 232 to the PSCU 219. In some embodiments, the setpoint parameter determined by setpoint determination logic 239 may be communicated and provided by the HCU 234 to the PSCU 219. In the example embodiment, the PSCU 219 receives the setpoint parameter in the foregoing or other manners, and adjusts the variable voltage supplied to the HCU 234 in response to the setpoint parameter.

In the illustrated embodiment, power converter 236 is configured and provided as a DC-DC power converter which is operatively coupled with and configured to receive DC power from power supply 220 which may provide such electrical power from one or more electrical storage and/or generation systems. In some forms, power converter 236 may be configured and provided in the form of a buck converter such as an interleaved buck converter. In other embodiments, power converter 236 may be configured and provided as another type of DC-DC converter. In other embodiments, power converter 236 may be configured and provided as AC-DC power converter which is operatively coupled with and configured to receive AC power from power supply 220.

In the illustrated embodiment, power converter 266 is configured and provided as a DC-DC power converter which is operatively coupled with and configured to receive DC power from power supply 220 which may provide such electrical power from one or more electrical storage and/or generation systems. In some forms, power converter 266 may be configured and provided in the form of a buck converter such as an interleaved buck converter. In other embodiments, power converter 266 may be configured and provided as another type of DC-DC converter. In other embodiments, power converter 266 may be configured and provided as AC-DC power converter which is operatively coupled with and configured to receive AC power from power supply 220.

The architectures and topologies described in connection with FIG. 2 may be utilized and provided in a number of forms. Some such forms may comprise a first power converter channel such as the channel of power converter 236 configured to drive a first heater such as heater 242, and a second power converter channel such as the channel of power converter 266 configured to drive a second heater such as heater 262. Some such forms may comprise different arrangements of multichannel power converters and heater loads including the following examples. In some embodiments, for example, some such forms may comprise a single power converter channel configured to drive two or more heaters. In some embodiments, some such forms may comprise two power converter channels configured to drive a single heater. In other example embodiment, some such forms may comprise a single channel configured to drive two heaters in parallel. Yet, in other example embodiments, some such forms may comprise a single channel configured to drive two heaters in series.

Figure 3:
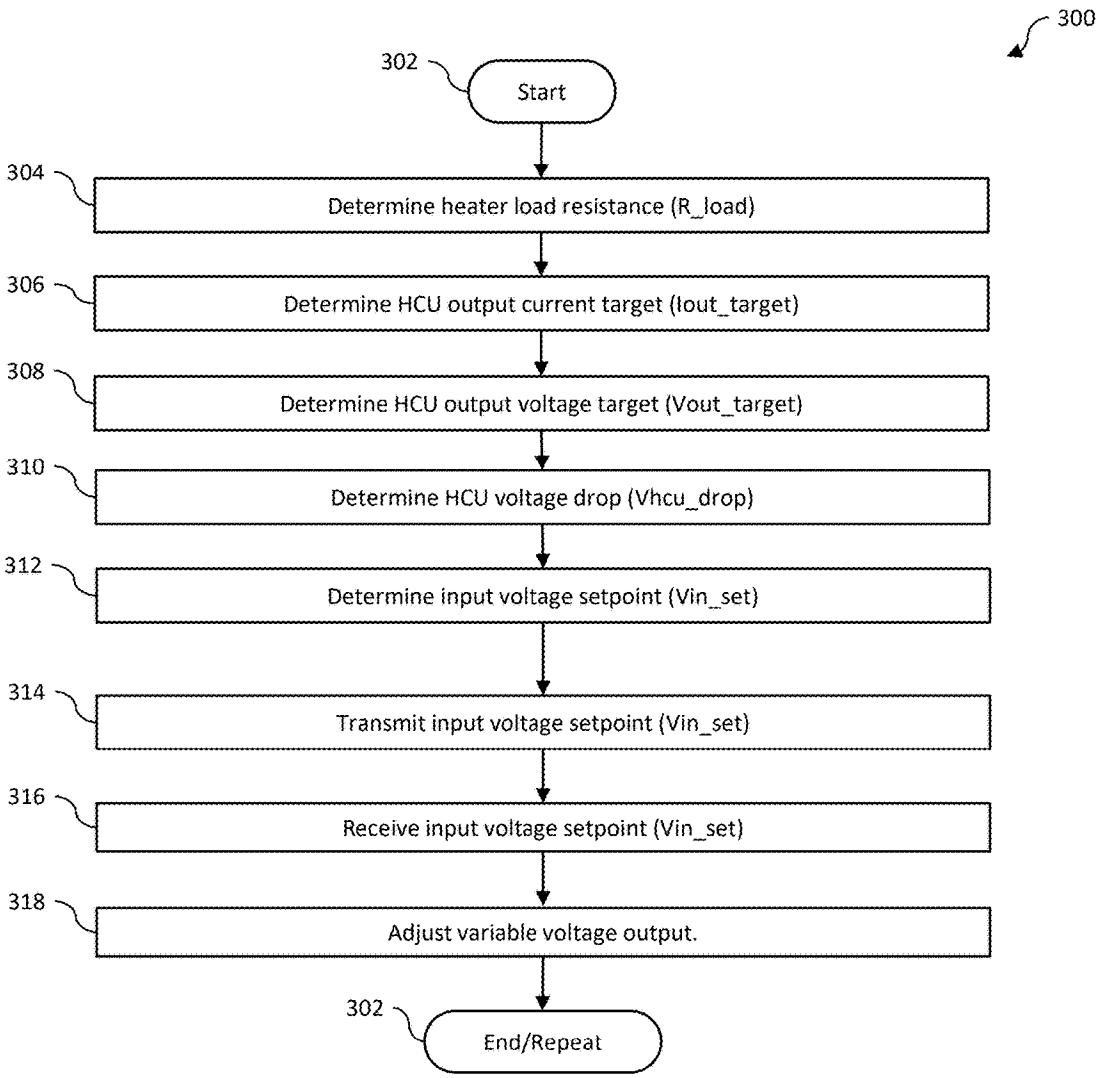
FIG. 3 is a flowchart illustrating certain aspects of an example control process.

With reference to FIG. 3, there is illustrated a flowchart depicting certain aspects of an example control process 300 (also referred to herein as process 300). Process 300 is described in connection with ECU 232, HCU 234 and PSCU 219, it being appreciated that process 300 may be implemented and performed in connection with various other electronic control units and electronic control system components.

Process 300 begins at start operation 302 and proceeds to operation 304 at which the heater load resistance (R_load) is determined, for example, in response to a measured output voltage of the HCU and a measured output current of the HCU. Operation 304 may utilize, for example, the techniques, calculations, and/or operations described above in connection with setpoint determination logic 239.

From operation 304, process 300 proceeds to operation 306 at which the target HCU output current (Iout_target) is determined by the commanded power output and the heater load resistance (R_load). Operation 306 may utilize, for example, the techniques, calculations, and/or operations described above in connection with setpoint determination logic 239.

From operation 306, process 300 proceeds to operation 308 at which the target HCU output voltage (Vout_target) is determined by the commanded power output (P_command) and the target HCU output current (Iout_target). Operation 308 may utilize, for example, the techniques, calculations, and/or operations described above in connection with setpoint determination logic 239.

From operation 308, process 300 proceeds to operation 310 at which the HCU voltage drop (Vhcu_drop) is determined by a real-time measurement of an input voltage and output voltage of the HCU. For example, the HCU voltage drop (Vhcu_drop) may be a forward voltage drop across the HCU input to output. Operation 308 may utilize, for example, the techniques, calculations, and/or operations described above in connection with setpoint determination logic 239.

From operation 310, process 300 proceeds to operation 312 at which the input voltage setpoint (Vin_set) is determined. In some embodiments, the input voltage setpoint (Vin_set) may be the setpoint parameter which is determined by the target HCU output voltage (Vout_target), the HCU voltage drop (Vhcu_drop), and an optimal duty cycle (DChcu_opt) of the HCU. Operation 312 may utilize, for example, the techniques, calculations, and/or operations described above in connection with setpoint determination logic 239.

From operation 312, process 300 proceeds to operation 314 at which the input voltage setpoint (Vin_set) is transmitted by the HCU. For example, the setpoint parameter may be transmitted by the HCU to the PSCU, or may be transmitted by the HCU to the ECU and, in turn, transmitted by the ECU to the PSCU.

From operation 314, process 300 proceeds to operation 316 at which the input voltage setpoint (Vin_set) is received by the PSCU. From operation 316, process 300 proceeds to operation 318 at which the PSCU sets (for example, adjusts or maintains) its variable output voltage in response to the received input voltage setpoint (Vin_set). The variable output voltage is, in turn, provided as the input voltage to the HCU.

As shown by this detailed description, the present disclosure contemplates multiple and various embodiments, including, without limitation, the following example embodiments.

A first example embodiment is a system comprising: an exhaust aftertreatment system including a heater configured to provide heat to a catalyst; a heater control unit (HCU) configured to supply electrical power to the heater; and a power supply control unit (PSCU) configured to supply electrical power to the HCU at a variable voltage, wherein the HCU is configured to determine a setpoint parameter, the setpoint parameter varying in response to variation in a commanded power output of the HCU to drive the heater, the PSCU configured to receive the setpoint parameter and to adjust the variable voltage supplied to the HCU in response to the setpoint parameter, and the adjustment of the setpoint parameter is effective to optimize an efficiency of the HCU during operation to supply the commanded power output to the heater.

A second example embodiment includes the features of the first example embodiment, wherein the HCU is configured to receive the commanded power output from an engine control unit (ECU).

A third example embodiment includes the features of the first example embodiment, wherein the HCU is configured to determine a heater load resistance in response to a measured output voltage of the HCU and a measured output current of the HCU.

A fourth example embodiment includes the features of the third example embodiment, wherein the HCU is configured to determine a target output current in response to the commanded power output and the heater load resistance, and to determine a target output voltage in response to the commanded power output and the target output current.

A fifth example embodiment includes the features of the fourth example embodiment, wherein the HCU is configured to determine a voltage drop across the HCU in response to at least one of (a) an input voltage measurement and an output voltage measurement, and (b) a predetermined value.

A sixth example embodiment includes the features of the fifth example embodiment, wherein the HCU is configured to determine the setpoint parameter in response to the voltage target, the voltage drop across the HCU, and an optimal power converter duty cycle.

A seventh example embodiment includes the features of the second example embodiment, wherein the ECU is configured to communicate with the HCU via a first controller area network and configured to communicate with the PSCU via a second controller area network.

An eighth example embodiment includes the features of the first example embodiment, wherein the PSCU comprises a motor generator unit (MGU).

A ninth example embodiment includes the features of the second example embodiment, wherein the HCU is configured to provide the setpoint parameter to the ECU and the ECU is configured to provide the setpoint parameter to the HCU.

A tenth example embodiment includes the features of the first example embodiment, wherein the HCU is configured to supply electrical power to a plurality of heaters.

An eleventh example embodiment is a method of operating an exhaust aftertreatment system including a heater configured to provide heat to a catalyst, the method comprising: operating a heater control unit (HCU) to supply electrical power to the heater; operating a power supply control unit (PSCU) to supply electrical power to the HCU at a variable voltage; determining a setpoint parameter with the HCU, the setpoint parameter varying in response to variation in a commanded power output of the HCU to drive the heater; receiving the setpoint parameter with the PSCU; adjusting with the PSCU the variable voltage supplied to the HCU in response to the setpoint parameter, and the adjustment of the setpoint parameter is effective to optimize an efficiency of the HCU during operation to supply the commanded power output to the heater.

A twelfth example embodiment includes the features of the eleventh example embodiment, comprising the HCU receiving the commanded power output from an engine control unit (ECU).

A thirteenth example embodiment includes the features of the eleventh example embodiment, comprising the HCU determining a heater load resistance in response to a measured output voltage of the HCU and a measured output current of the HCU.

A fourteenth example embodiment includes the features of the thirteenth example embodiment, wherein comprising the HCU determining a target output current in response to the commanded power output and the heater load resistance and determining a target output voltage in response to the commanded power output and the target output current.

A fifteenth example embodiment includes the features of the fourteenth example embodiment, comprising the HCU determining a voltage drop across the HCU in response to at least one of (a) an input voltage measurement and an output voltage measurement, and (b) a predetermined value.

A sixteenth example embodiment includes the features of the fifteenth example embodiment, comprising the HCU determining the setpoint parameter in in response to the voltage target, the voltage drop across the HCU, and an optimal power converter duty cycle.

A seventeenth example embodiment includes the features of the twelfth example embodiment, comprising the ECU communicating with the HCU via a first controller area network and communicating with the PSCU via a second controller area network.

An eighteenth example embodiment includes the features of the eleventh example embodiment, wherein the PSCU comprises a motor generator unit (MGU).

A nineteenth example embodiment includes the features of the twelfth example embodiment, comprising the HCU providing the setpoint parameter to the ECU and the ECU providing the setpoint parameter to the HCU.

A twentieth example embodiment includes the features of the eleventh example embodiment, comprising the HCU supplying electrical power to a plurality of heaters.

It shall be appreciated that terms such as "a non-transitory memory," "a non-transitory memory medium," and "a non-transitory memory device" refer to a number of types of devices and storage mediums which may be configured to store information, such as data or instructions, readable or executable by a processor or other components of a computer system and that such terms include and encompass a single or unitary device or medium storing such information, multiple devices or media across or among which respective portions of such information are stored, and multiple devices or media across or among which multiple copies of such information are stored.

It shall be appreciated that terms such as "determine," "determined," "determining" and the like when utilized in connection with a control method or process, an electronic control system or controller, electronic controls, or components or operations of the foregoing refer inclusively to a number of acts, configurations, devices, operations, and techniques including, without limitation, calculation or computation of a parameter or value, obtaining a parameter or value from a lookup table or using a lookup operation, receiving parameters or values from a datalink or network communication, receiving an electronic signal (e.g., a voltage, frequency, current, or pulse-width modulation (PWM) signal) indicative of the parameter or value, receiving output of a sensor indicative of the parameter or value, receiving other outputs or inputs indicative of the parameter or value, reading the parameter or value from a memory location on a computer-readable medium, receiving the parameter or value as a run-time parameter, and/or by receiving a parameter or value by which the interpreted parameter can be calculated, and/or by referencing a default value that is interpreted to be the parameter value.

While example embodiments of the disclosure have been illustrated and described in detail in the drawings and foregoing description, the same is to be considered as illustrative and not restrictive in character, it being understood that only certain example embodiments have been shown and described and that all changes and modifications that come within the spirit of the claimed inventions are desired to be protected. It should be understood that while the use of words such as preferable, preferably, preferred or more preferred utilized in the description above indicates that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system comprising:

an exhaust aftertreatment system including a heater configured to provide heat to a catalyst;

a heater control unit (HCU) configured to supply electrical power to the heater; and a power supply control unit (PSCU) configured to supply electrical power to the HCU at a variable voltage, wherein the HCU is configured to determine a setpoint parameter, the setpoint parameter varying in response to variation in a commanded power output of the HCU to drive the heater, the PSCU configured to receive the setpoint parameter and to adjust the variable voltage supplied to the HCU in response to the setpoint parameter, and the adjustment of the setpoint parameter is effective to optimize an efficiency of the HCU during operation to supply the commanded power output to the heater.

2. The system of claim 1, wherein the HCU is configured to receive the commanded power output from an engine control unit (ECU).

3. The system of claim 1, wherein the HCU is configured to determine a heater load resistance in response to a measured output voltage of the HCU and a measured output current of the HCU.

4. The system of claim 3, wherein the HCU is configured to determine a target output current in response to the commanded power output and the heater load resistance, and to determine a target output voltage in response to the commanded power output and the target output current.

5. The system of claim 4, wherein the HCU is configured to determine a voltage drop across the HCU in response to at least one of (a) an input voltage measurement and an output voltage measurement, and (b) a predetermined value.

6. The system of claim 5, wherein the HCU is configured to determine the setpoint parameter in response to the voltage target, the voltage drop across the HCU, and an optimal power converter duty cycle.

7. The system of claim 2, wherein the ECU is configured to communicate with the HCU via a first controller area network and configured to communicate with the PSCU via a second controller area network.

8. The system of claim 1, wherein the PSCU comprises a motor generator unit (MGU).

9. The system of claim 2, wherein the HCU is configured to provide the setpoint parameter to the ECU and the ECU is configured to provide the setpoint parameter to the HCU.

10. The system of claim 1, wherein the HCU is configured to supply electrical power to a plurality of heaters.

11. A method of operating an exhaust aftertreatment system including a heater configured to provide heat to a catalyst, the method comprising:

operating a heater control unit (HCU) to supply electrical power to the heater;

operating a power supply control unit (PSCU) to supply electrical power to the HCU at a variable voltage;

determining a setpoint parameter with the HCU, the setpoint parameter varying in response to variation in a commanded power output of the HCU to drive the heater;

receiving the setpoint parameter with the PSCU;

adjusting with the PSCU the variable voltage supplied to the HCU in response to the setpoint parameter, and the adjustment of the setpoint parameter is effective to optimize an efficiency of the HCU during operation to supply the commanded power output to the heater.

12. The method of claim 11, comprising the HCU receiving the commanded power output from an engine control unit (ECU).

13. The method of claim 11, comprising the HCU determining a heater load resistance in response to a measured output voltage of the HCU and a measured output current of the HCU.

14. The method of claim 13, comprising the HCU determining a target output current in response to the commanded power output and the heater load resistance and determining a target output voltage in response to the commanded power output and the target output current.

15. The method of claim 14, comprising the HCU determining a voltage drop across the HCU in response to at least one of (a) an input voltage measurement and an output voltage measurement, and (b) a predetermined value.

16. The method of claim 15, comprising the HCU determining the setpoint parameter in in response to the voltage target, the voltage drop across the HCU, and an optimal power converter duty cycle.

17. The method of claim 12, comprising the ECU communicating with the HCU via a first controller area network and communicating with the PSCU via a second controller area network.

18. The method of claim 11, wherein the PSCU comprises a motor generator unit (MGU).

19. The method of claim 12, comprising the HCU providing the setpoint parameter to the ECU and the ECU providing the setpoint parameter to the HCU.

20. The method of claim 11, comprising the HCU supplying electrical power to a plurality of heaters.

* * * * *